United States Patent [19]

Kurotori et al.

[11] Patent Number: 4,985,733

[45] Date of Patent: Jan. 15, 1991

[54] IMAGE FIXING UNIT FOR USE IN WET-TYPE ELECTROPHOTOGRAPHIC COPYING MACHINE

[75] Inventors: Tsuneo Kurotori, Tokyo; Manabu Mochizuki; Kenzo Ariyama, both of Yokohama; Ichiro Tsuruoka; Hiroaki Takenouchi, both of Tokyo; Katsuhiro Echigo, Yokohama, all of Japan

[73] Assignee: Ricoh Company, Ltd., Tokyo, Japan

[21] Appl. No.: 331,649

[22] Filed: Mar. 31, 1989

[30] Foreign Application Priority Data

| | | | |
|---|---|---|---|
| Apr. 2, 1988 | [JP] | Japan | 63-82624 |
| Jun. 20, 1988 | [JP] | Japan | 63-151575 |
| Jan. 6, 1989 | [JP] | Japan | 64-332[U] |
| Jan. 12, 1989 | [JP] | Japan | 1-2422 |
| Jan. 13, 1989 | [JP] | Japan | 1-2932 |
| Jan. 17, 1989 | [JP] | Japan | 1-8230 |

[51] Int. Cl.[5] ..... G03G 15/10; G03G 15/20

[52] U.S. Cl. ..... 355/282; 355/256; 355/290; 118/116

[58] Field of Search ..... 355/256, 282, 285, 289, 355/290, 217, 271; 118/109, 659–662, 115–117

[56] References Cited

U.S. PATENT DOCUMENTS

| | | | |
|---|---|---|---|
| 3,630,608 | 12/1971 | Sage | 355/217 X |
| 3,663,219 | 5/1972 | Takahashi | 355/256 X |
| 3,972,611 | 8/1976 | Tanaka et al. | 355/256 |
| 4,286,039 | 8/1981 | Landa et al. | 118/661 X |

*Primary Examiner*—Joan H. Pendegrass

*Attorney, Agent, or Firm*—Oblon, Spivak, McClelland, Maier & Neustadt

[57] ABSTRACT

An image fixing unit for a wet-type electrophotographic copying machine capable of forming a latent electrostatic image on a photoconductor element, developing the latent electrostatic image to a visible toner image by a developer comprising a carrier liquid and toner particles and transferring the visible toner image to a transfer sheet, is disclosed, which comprises (a) a non-thermal carrier liquid content reduction device for reducing the content of the carrier liquid in the developer deposited imagewise on the transfer sheet without application of heat thereto; and (b) a thermal image fixing device for fixing the toner image to the transfer sheet by directly heating the toner image formed on the transfer sheet after the reduction of the content of the carrier liquid in the imagewise deposited developer by the non-thermal carrier liquid content reduction device.

9 Claims, 12 Drawing Sheets

IMAGE FIXING UNIT FOR USE IN WET-TYPE ELECTROPHOTOGRAPHIC COPYING MACHINE

BACKGROUND OF THE INVENTION

1. Field of the Invention

The present invention relates to an image fixing unit for use in a wet-type electrophotographic copying machine.

2. Background of the Related Art

In a wet-type electrophotographic copying machine, there is conventionally known an image fixing method comprising the steps of developing a latent electrostatic image formed on a photoconductive member to a visible toner image with a liquid-type developer, transferring the visible toner image to a transfer sheet, and fixing the transferred image to the transfer sheet by bringing a heat application means into direct contact with the toner-image-bearing surface of the transfer sheet.

As shown in FIG. 1, for example, a heat-application roller 1 with an inner heater 3 serving as a heat-application means incorporated therein is disposed along a transfer sheet transportation path through which an unfixed-toner-image bearing transfer sheet P advances in the direction of the arrow, and a pressure-application roller 2 is in pressure contact with the heat-application roller 1. More specifically, a cam surface of a pressure-application cam 5 is in pressure contact with a shaft portion of the pressure-application roller 2 by the urging force of a spring 6, so that a predetermined pressure is applied to the pressure-application roller 2, thus the pressure-application roller 2 is brought into pressure contact with the heat-application roller 1. Around the heat-application roller 1, a thermistor 7 and a temperature-control fuse 8 are provided to control the temperature of the heat-application roller 1. A transfer sheet separating pawl 10 and a silicone-oil-application felt 11 are situated in contact with the surface of the heat-application roller 1 and prevent the transfer sheet from winding around the heat-application roller 1.

However, the above-mentioned conventional image fixing unit for use in an electrophotographic copying machine has the shortcoming that the image quality of fixed image varies depending on the kind or type of a transfer sheet P employed. In particular, when transfer sheets which scarcely absorb a carrier liquid contained in a liquid developer, such as a transparent film for overhead projectors (OHP), an intermediate original sheet and art paper, are employed, an unfixed toner image on the transfer sheet is caused to corrupt or flow as shown in FIG. 2 in the course of image fixing and accordingly the fixed image becomes illegible. In the figure, the arrow indicates the transporting direction of the transfer sheet during the image fixing process.

In order to solve the above problem, an image fixing test was carried out to analyze the relationship between carrier liquid retention ratio in a developer deposited on a variety of transfer sheets and the occurrence of image flow in the obtained images.

The above-mentioned carrier liquid retention ratio of the developer was obtained by the following formula:

$$\text{Carrier liquid retention ratio (\%)} = \frac{[\text{Total weight of transfer sheet before dried(g)}] - [\text{Total weight of transfer sheet after dried(g)}]}{\text{Total weight of transfer sheet before dried(g)}} \times 100$$

To obtain the above-mentioned carrier liquid retention ratio of the employed developer, a liquid-type developer was prepared by dispersing and diluting a thermal cross-linking toner in a carrier liquid such as "Isopar H" made by Exxon Co., with a dilution ratio of 50 g/l. Latent electrostatic images were developed to toner images on a commercially available transparent film for OHP (Trademark "TYPE PPC-DX" (A4 size) made by Ricoh Company Ltd.), by use of the above-mentioned developer and a commercially available electrophotographic copying machine. The thus developed OHP film was taken out from the electrophotographic copying machine before reaching an image fixing unit. The weight of the OHP film was measured. After this measurement, the OHP film was then dried through the image fixing unit of the electrophotographic copying machine to evaporate the carrier liquid, and the weight thereof was measured. In the above-mentioned image fixing test, the fixing temperature was adjusted to 140° ±10° C. and the paper feeding linear speed set at 350 mm/sec.

The results are given in Table 1.

TABLE 1

| Solvent Retention Ratio (%) | Image Flow | | | |
|---|---|---|---|---|
| | OHP Film (*) | Intermediate Original Sheet (**) | Art Paper (***) | Plain Paper (T-6200) |
| 77 | 1 | 1 | 2 | 5 |
| 72 | 2 | 2 | 3 | 5 |
| 68 | 2 | 3 | 3 | 5 |
| 65 | 2.5 | 3 | 3.5 | 5 |
| 60 | 3 | 3 | 4 | 5 |
| 55 | 4 | 4 | 5 | 5 |
| 45 | 4.5 | 5 | 5 | 5 |
| 9 | 5 | 5 | 5 | 5 |

(*) A commercially available transparent film for the OHP "TYPE PPC-DX" made by Ricoh Company Ltd.
(**) A commercially available intermediate original sheet "TYPE TA" made by Ricoh Company Ltd.
(***) A commercially available duplex coated paper.

In Table 1, the image flow was evaluated by visual inspection and the degree of the image flow is expressed by the following ranking scale:

1: Image flow is observed in all the obtained images and characters are illegible.
2: Image flow is slightly observed in the obtained images and the image density of the solid image areas is low.
3: Image flow is less, but the characters in the solid image areas spread.
4: Image flow is hardly observed and the characters in the solid image areas slightly spread.
5: Image flow is not observed at all and the characters in the solid image areas are clear.

The results in Table 1 indicate that when the carrier liquid retention ratio in the developer deposited on the transfer sheet is 65% or more, image flow takes place to some extent in the fixed images on the OHP film, the intermediate original sheet and the art paper.

To prevent the image flow in the course of image fixing, several trials have been made to decrease the carrier liquid retention ratio prior to image fixing by heating. For example, a pair of a rigid blotter roller and an elastic back-up roller is provided upstream of thermal image fixing rollers (heat-application roller and pressure-application roller). The blotter roller absorbs the carrier liquid contained in the developer deposited on the transfer sheet. However, since the above-mentioned blotter roller is a rigid roller and the back-up roller is elastic, the nip between the two rollers is in a concave shape due to the deformation of the elastic back-up roller. Accordingly, the transfer sheet is discharged from the above-mentioned nip between the two rollers, with a front surface thereof curled concavely (referred to as "face-curl"). Thus, such a rigid blotter roller has the shortcomings that transfer sheet transportation reliability cannot be ensured due to the face-curl of the transfer sheet and therefore there is the risk that the transfer sheet is easily wound around the blotter roller.

In order to solve this problem, there is proposed a method of securely guiding the curled transfer sheet along the transfer sheet path. For example, a paper guide plate and a paper separating pawl are arranged around the blotter roller. However, the toner deposited on the transfer sheet has not yet been fixed completely in this stage, so that there is the risk that the toner images formed on the transfer sheet are damaged or smeared by these guide plate and paper separating pawl.

In the case where the distance between a transfer unit and an image fixing unit is relatively long, a pair of transporting rollers are conventionally provided halfway between the transfer unit and the image fixing unit, especially for the transportation of small-sized transfer sheets. However, when a pair of the blotter roller and the back-up roller and a pair of the transporting rollers are arranged halfway between the transfer unit and the image fixing unit, the manufacturing cost is increased and paper transportation reliability is decreased.

SUMMARY OF THE INVENTION

It is therefore an object of the present invention to provide an improved image fixing unit for use in an electrophotographic copying machine free from the conventional shortcomings, capable of decreasing the carrier liquid retention ratio of a developer deposited on transfer sheets, in particular on a transfer sheet with low carrier liquid absorbing capacity, in the course of image fixing, thereby minimizing the occurrence of image flow and providing clear and sharp images.

The above object of the present invention can be achieved by disposing, before a thermal image fixing unit for fixing toner images to a transfer sheet by direct heat application thereto, an image fixing unit having a means for decreasing the carrier liquid retention ratio of a developer deposited imagewise on the transfer sheet without application of heat.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIGS. 9-1 and 9-2 are schematic diagrams of a seventh example of an image fixing unit according to the present invention;

FIGS. 11-1, 11-2 and 11-3 are diagrams of a ninth example of an image fixing unit according to the present invention;

FIGS. 12-1 and 12-2 are schematic diagrams of a tenth example of an image fixing unit according to the present invention;

DETAILED DESCRIPTION OF THE PREFERRED EMBODIMENTS

Figure 1:
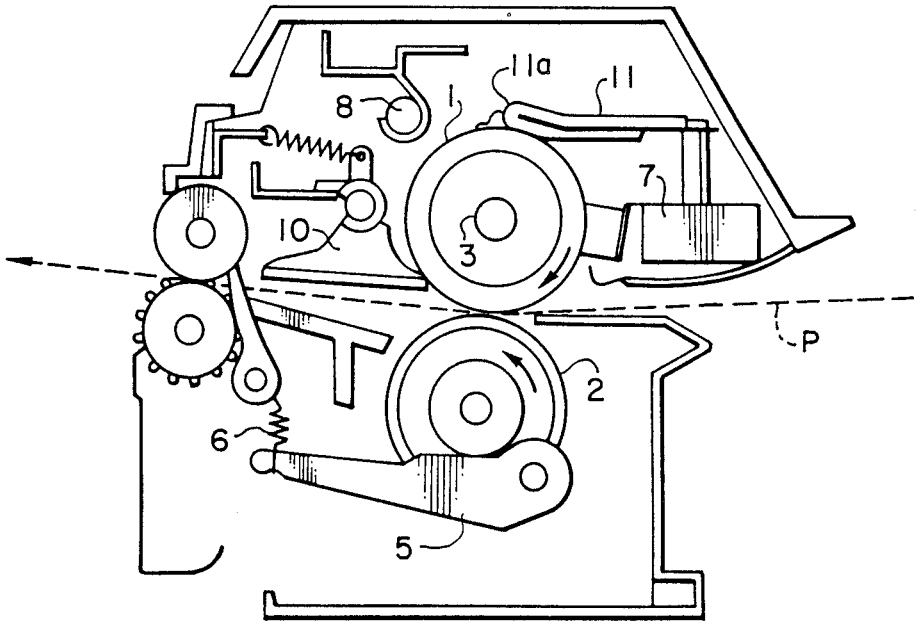
FIG. 1 PRIOR ART
FIG. 1 is a schematic diagram of an example of a conventional image fixing unit for use in an electrophotographic copying machine.

An image fixing unit for use in a wet-type electrophotographic copying machine according to the present invention will now be explained in detail by referring to the accompanying drawings. In the drawings, like reference numerals designate identical or corresponding parts throughout the several views, and more particularly to FIG. 3 thereof.

The image-fixing unit according to the present invention is for use in a wet-type electrophotographic copying machine capable of forming a latent electrostatic image on a photoconductor element, developing the latent electrostatic image to a visible toner image by a developer comprising a carrier liquid and toner particles, and transferring the visible toner image to a transfer sheet, and comprises (a) a non-thermal carrier liquid content reduction means for reducing the content of the carrier liquid in the developer deposited imagewise on the transfer sheet without application of heat thereto; and (b) a thermal image fixing means for fixing the toner image to the transfer sheet by directly heating the toner image formed on the transfer sheet after the reduction of the content of the carrier liquid in the imagewise deposited developer by the non-thermal carrier liquid content reduction means.

Other features of this invention will become apparent in the course of the following description of exemplary embodiments, which are given for illustration of the invention and are not intended to be limiting thereof.

Figure 3:
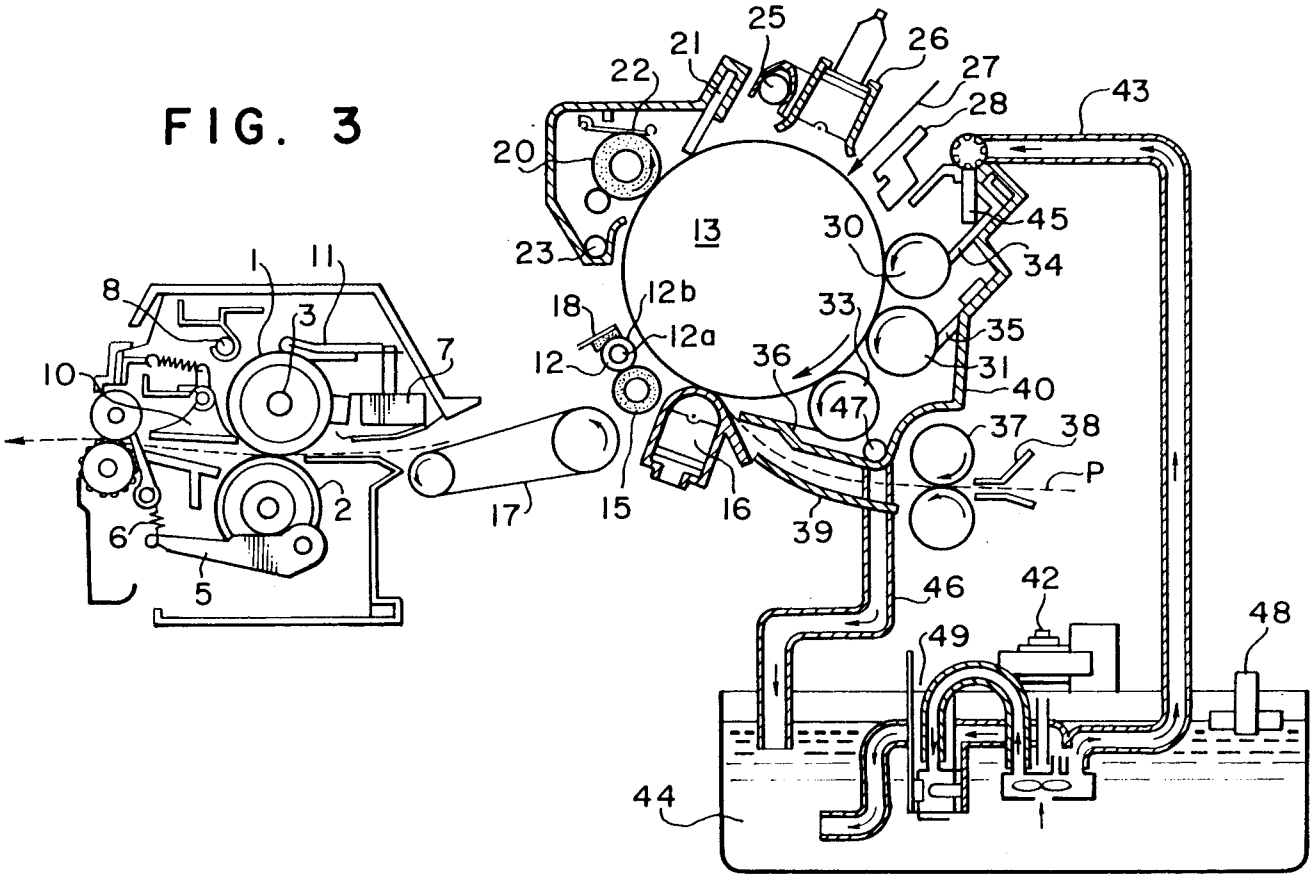
FIG. 3 is a schematic diagram of a first example of an image fixing unit according to the present invention for use in an electrophotographic copying machine.

FIG. 3 schematically shows a first example of the image fixing unit according to the present invention. In this example, a blotter roller 12 is employed as a member of a non-thermal carrier liquid content reduction means for decreasing the carrier liquid retention ratio of a developer deposited on a transfer sheet P without application of heat in the image fixing unit. The blotter roller 12 comprises a core member 12*a* and a carrier-liquid-absorbing material 12*b* which covers the core member 12*a*.

The blotter roller 12 is situated around a photoconductor drum 13 so as to come into rolling contact with a sponge roller 15 serving as a back-up roller for bringing an unfixed-toner-image bearing transfer sheet P into contact with the blotter roller 12. A carrier liquid component contained in a developer deposited imagewise by an image-transfer charger 16 on the transfer sheet P is absorbed by the blotter roller 12 to a predetermined carrier liquid retention ratio. Suitable materials for the carrier-liquid-absorbing material 12*b* of the blotter roller 12 are a porous material such as a nonwoven fabric or cotton, and an elastic material such as silicone rubber, having a swelling tendency when wetted with a carrier liquid, such as Isopar H.

In the electrophotographic copying machine as shown in FIG. 3, the photoconductor drum 13 is driven in rotation by a driving system (not shown) in the direction of the arrow at a predetermined speed when copying is performed, and is uniformly charged by a main charger 26. The uniformly charged surface of the photoconductor drum 13 is exposed to a light image 27 to form a latent electrostatic image thereon corresponding to the light image 27. The electrical charge in the areas outside the image formation area on the photoconductor drum 13 is quenched by a charge eraser 28.

The latent electrostatic image formed on the photoconductor drum 13 is developed to a visible toner image in a developing unit comprising a first developing roller 30 and a second developing roller 31 which are disposed with a small gap from the surface of the photoconductor drum 13, and rotated in a direction opposite to the rotating direction of the photoconductor drum 13. Reference numeral 33 indicates a reverse roller, which is designed to rotate in the same direction as the rotating direction of the photoconductor drum 13, and functions to scrape an excessive liquid developer off the surface of the photoconductor drum 13. Reference numerals 34, 35 and 36 indicate scrapers for scraping the excessive liquid developer off the first developing roller 30, the second developing roller 31 and the reverse roller 33, respectively. Reference numeral 40 indicates an external wall of this developing unit which serves as a developer receiving plate as well. The liquid developer recovered by the scrapers 34, 35 and 36 is returned into a developer tank 44 through a developer recovery hole 47 and a developer recovery pipe 46. The liquid developer in the developer tank 44 is sucked up by a developer suction pump 42 and supplied to the first and second developing rollers 30 and 31 through a developer supply pipe 43. Reference numeral 45 indicates a nozzle attached to the end of the developer supply pipe 43. Reference numerals 48 and 49 respectively indicate a liquid level detecting float sensor and a toner density detecting sensor incorporated in the developer tank 44.

A transfer sheet P is fed from a transfer sheet supply system (not shown) through a pair of transfer sheet feeding guides 38 and a pair of transfer sheet feeding rollers 37 and transported toward the image-transfer charger 16 along a transfer sheet transportation guide 39.

The developed toner image is transferred from the surface of the photoconductor drum 13 to the transfer sheet P by the image-transfer charger 16, so that the transfer sheet P is caused to bear an unfixed toner image thereon.

The unfixed-toner-image bearing transfer sheet P is separated from the photoconductor drum 13 and enters the nip between the blotter roller 12 and the sponge roller 15. While the transfer sheet P passes through the nip between the blotter roller 12 and the sponge roller 15, the carrier liquid component contained in the developer deposited imagewise on the transfer sheet P is sucked up by the blotter roller 12.

The transfer sheet P is then transported into an image fixing unit by a transfer sheet transportation belt 17. In the image fixing unit, a pressure-application roller 2 is in contact with a heat-application roller 1 having an inner heater 3, so that the toner image formed on the transfer sheet P is thermally fixed thereto while the transfer sheet P passes through the nip between the heat-application roller 1 and the pressure-application roller 2. The transfer sheet is then discharged from the image fixing unit.

After the transfer sheet P is separated from the photoconductor drum 13, toner particles remaining on the surface of the photoconductor drum 13 are removed therefrom by a cleaning foam roller 20 and a cleaning blade 21. Reference numerals 22 and 23 respectively indicate a developer diffusion plate and a developer discharge hole. The residual electrical charge on the photoconductor drum 13 is quenched by a quenching lamp 25 prior to the subsequent formation of latent electrostatic images on the photo-conductor drum 13.

While the toner-image bearing transfer sheet P is caused to pass between the blotter roller 12 and the sponge roller 15, a small amount of the toner particles may be deposited on the surface of the blotter roller 12. According to the present invention, however, a cleaning pad 18 is provided in contact with the surface of the blotter roller 12 and the toner particles deposited on the blotter roller 12 are scraped therefrom by the cleaning pad 18, so that the carrier-liquid-absorbing capacity of the blotter roller 12 is not decreased with time even if the toner particles are deposited on the blotter roller 12 and excellent image quality is maintained in the course of repeated copying performance.

Figure 4:
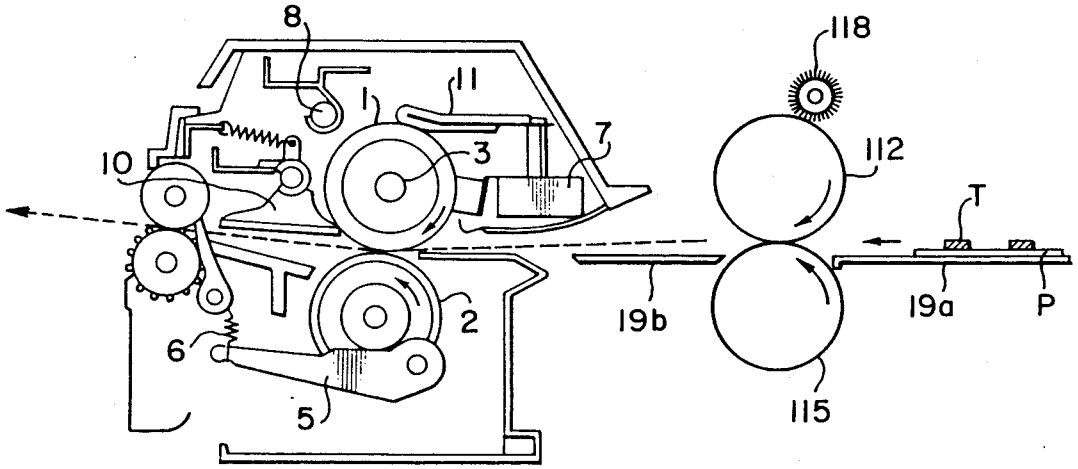
FIG. 4 is a schematic diagram of a second example of an image fixing unit according to the present invention.

FIG. 4 schematically shows a second example of an image fixing unit according to the present invention. In the figure, a blotter roller 112 is in contact with a back-up roller 115 with a predetermined pressure therebetween. Reference numeral 118 indicates a cleaning brush roller serving as a cleaning member which is situated in contact with the blotter roller 112 to clean the surface of the blotter roller 112 in the same manner as the cleaning pad 18 shown in FIG. 3. Reference numerals 19*a* and 19*b* respectively indicate an inlet guide plate and a relay guide plate for transportation of the transfer sheet P.

The blotter roller 112 shown in FIG. 4 is preferably made of a material having a porous structure, such as a nonwoven fabric of cotton or synthetic fibers, for example, a commercially available fiber "Clarino", made by Kuraray Co., Ltd. Of such materials, polypropylene which is also capable of chemically adsorbing a petroleum solvent is a preferable material for the blotter roller 112.

It is preferable that the material for the cleaning brush roller 118 be selected, with the properties of the blotter roller 112 and the type of the carrier liquid employed in the developer taken into consideration. More specifically, it is preferable that the cleaning brush roller 118 be brought into light uniform contact with the surface of the blotter roller 112 because the blotter roller 112 is made of a comparatively soft and porous material and the carrier liquids employed in the developer for a conventional electrophotographic copying machine are of a petroleum-type, such as "Isopar" made by Exxon Chemical Japan Ltd. Therefore a solvent-resistant material is preferable for the cleaning brush roller 118. From the above viewpoint, it is preferable that the cleaning brush roller 118 be made of an oil-resisting resinous fiber such as polyurethane or nylon.

Table 2 shows the relationship between the occurrence of image flow in the images formed on an OHP film and the presence of a cleaning member for the blotter roller, obtained in an image fixing test which was carried out under the following conditions:

(1) Cleaning member (Cleaning brush roller 118)

| (1) Cleaning member (Cleaning brush roller 118) | |
|---|---|
| Shape: | Brush-roller-shaped |
| Material: | Nylon of 210 denier/10 fillers |
| Fibrous nylon layer: | with a thickness of 2.6 ± 0.3 mm and a density of 800 fibers/inch$^2$ |
| Nip: | 2 mm |
| Load: | 500 g |
| Line speed: | 266 mm/sec. |

(2) OHP film

Commercially available OHP film sheet "TYPE PPC-DX" made by Ricoh Company Ltd.

(3) Developer

A developer disclosed in Japanese Laid-Open patent application No. 62-139426 by the same Applicants as those of the present application.

(4) Electrophotographic copying machine

Commercially available wet-type electrophotographic copying machine (Trademark "CT-5085" made by Ricoh Company Ltd.)

TABLE 2

| Cleaning Brush Roller | Number of OHP Sheets Subjected to Test (sheets) 50 | 100 | 200 | 300 |
|---|---|---|---|---|
| Used | 5 | 4.5 | 4 | 3.5 |

TABLE 2-continued

| Cleaning Brush Roller | Number of OHP Sheets Subjected to Test (sheets) 50 | 100 | 200 | 300 |
|---|---|---|---|---|
| Not used | 4.5 | 3 | 1.5 | 1 |

In the above, the image flow was evaluated by visual inspection and the degree of the image flow was expressed by the same ranking scale as in Table 1.

The results shown in Table 2 indicate that the image flow was observed when the cleaning brush roller was not used. This is because the toner particles are deposited on the surface of the blotter roller while in use, resulting in the deterioration of the carrier-liquid-absorbing capacity of the blotter roller with time.

Figure 5A:
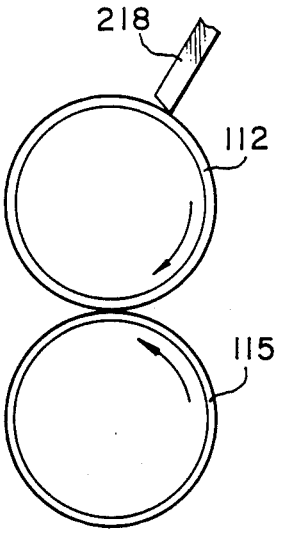
FIG. 5A is a schematic sectional view of an example of the combination of a blotter roller and a back-up roller for use in a third example of an image fixing unit according to the present invention.

FIG. 5A schematically shows a third example of an image fixing unit according to the present invention. In the figure, a polyurethane rubber blade 218 serving as a cleaning member, having a thickness of 5 mm is in pressure contact with a blotter roller 112 with a commercially available synthetic leather (Trademark "Clarino" made by Kuraray Co., Ltd.) wound therearound in a spiral configuration, with a bite between the blade 218 and the blotter roller 112 adjusted to 2 mm. The polyurethane rubber blade 218 is provided in order to raise the fine fibers of the synthetic leather "Clarino" wound around the blotter roller 112 because the fine fibers of the synthetic leather on the surface of the blotter roller 112 is gradually caused to "lie down" due to the pressure applied thereto by the back-up roller 115 in the course of the rotation thereof. When this takes place, the capillary action of the fibers of the blotter roller 112 is deteriorated and therefore the carrier-liquid-absorbing capacity thereof is decreased.

Figure 5B:
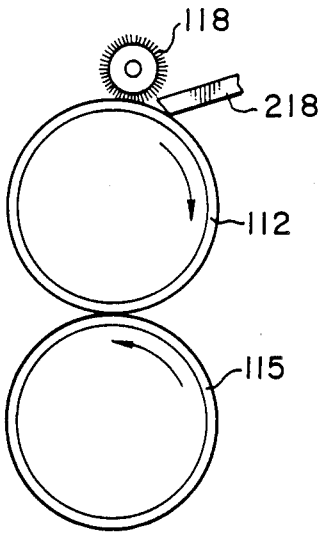
FIG. 5B is a schematic sectional view of another example of the combination of a blotter roller and a back-up roller for use in a fourth example of an image fixing unit according to the present invention.
Figure 6A:
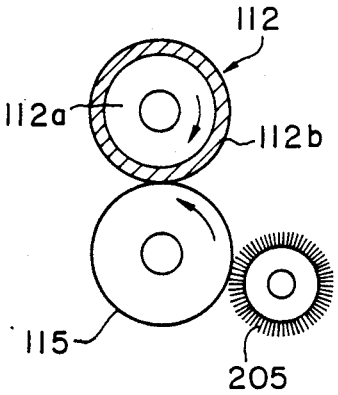
FIG. 6A is a schematic diagram of the combination of a blotter roller and a back-up roller, with a cleaning roller for the blotter roller for use in the present invention.
Figure 6B:
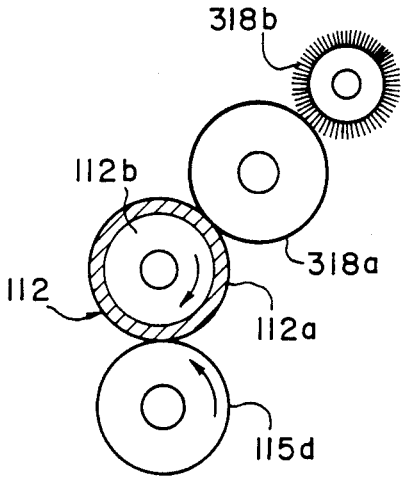
FIG. 6B is a schematic diagram of the combination of a blotter roller with two cleaning rollers therefor and a back-up roller for use in the present invention.

FIG. 5B schematically shows a fourth example of an image fixing unit according to the present invention, in which the above-mentioned polyurethane rubber blade 218 and the previously mentioned cleaning brush roller 118 are provided in combination in contact with the blotter roller 112.

An image fixing test was carried out in the same manner as in the image fixing test shown in Table 2 for evaluating the cleaning members shown in FIGS. 5A and 5B. In addition, a comparative cleaning member made by replacing the polyurethane rubber blade 218 employed in FIG. 5A with a metallic blade (not shown) was subjected to the same image fixing test as mentioned above. The results are shown in Table 3.

Table 3 particularly shows the relationship between the occurrence of image flow in the images formed on the same OHP film as employed previously and the configuration of the cleaning member(s) for the blotter roller 112.

The image flow was evaluated by visual inspection and the degree of the image flow was expressed by the same ranking scale as in Table 1.

TABLE 3

| Configuration of Cleaning Member [Fig. No.] | Number of OHP Sheets Subjected to Test (sheets) 50 | 100 | 200 | 300 |
|---|---|---|---|---|
| Polyurethane rubber blade [FIG. 5A] | 5 | 4.5 | 3.5 | 3 |
| Combination of polyurethane rubber blade and cleaning brush roller | 5 | 5 | 5 | 4.5 |

TABLE 3-continued

| Configuration of Cleaning Member [Fig. No.] | Number of OHP Sheets Subjected to Test (sheets) | | | |
|---|---|---|---|---|
| | 50 | 100 | 200 | 300 |
| [FIG. 5B] Metallic blade | 4 | 2 | — | — |

The results shown in Table 3 indicate that the polyurethane rubber blade 218 has a substantial cleaning effect although its cleaning effect did not reach the effect obtained by the previously mentioned cleaning brush roller as shown in FIG. 4. The combination of the polyurethane rubber blade 218 and the cleaning brush roller 118 had a sufficient cleaning effect for attaining good image quality even if 300 sheets of OHP films were continuously subjected to the image fixing test. By contrast, when the metallic blade was employed, the blotter roller 112 was not able to absorb the carrier liquid component containcd in the developer deposited on the OHP film any further after 200 sheets were caused to pass over the blotter roller 112. This is because the surface of the blotter roller 112 was shaved by the metallic blade.

As the cleaning member, the above-mentioned polyurethane rubber blade and/or cleaning brush roller have a function of removing the toner particles from the surface of the blotter roller. However, when the surface of the blotter roller is covered with fibrous materials such as a nonwoven fabric or a felt, so that its surface is porous, the toner particles may undesirably stick to each fiber of the fibrous material of the blotter roller and it may become difficult to scrape the toner particles off the blotter roller by the polyurethane rubber blade and/or cleaning brush roller.

In the above case, it preferable that the blotter roller 112 be constructed in such a manner that a core member **112*a* is covered with a carrier-liquid-absorbing material 112*b* such as a nonwoven fabric, a felt or a synthetic leather, and a back-up roller 115 be made of a metal, a resin or a rubber and be in contact with the blotter roller 112. The back-up roller 115 is produced by subjecting the surface thereof to knurling, sandblasting or filing by a sandpaper to make the surface rough. The thus formed rough surface of the back-up roller 115 can scrape the toner particles off the blotter roller 112, which are stuck to the fine porous surface of the blotter roller 112 when the back-up roller 115 comes into contact with the blotter roller 112. Thus the back-up roller 115 serves as a cleaning roller for the blotter roller 112** as well.

Furthermore, a brush roller 205 serving as a second cleaning roller for the back-up roller 115 is provided in contact with the above-mentioned back-up roller 115. The brush roller 205 is formed by covering a core with a straight-type or loop-type brush. Thus, toner particles removed from the blotter roller 112 and transferred to the roughened surface of the back-up roller 115 can be removed from the back-up roller 115 by the brush roller 205.

In this case, if the back-up roller 115 is brought into contact with the blotter roller 112 with a large pressure in order to improve the carrier liquid absorbing capacity of the blotter roller 112, there is the risk that the transfer sheet may be scratched by the roughened surface of the back-up roller 115.

In order to avoid the above risk, it is preferable to employ a back-up roller **115*d* having a smooth surface, made of a rubber or a metal, instead of the above-mentioned back-up roller 115. Further a cleaning roller 318*a* whose surface is roughened by knurling, sandblasting or filing by sandpaper is disposed in contact with the blotter roller 112 for cleaning the blotter roller 112. The cleaning roller 318*a* may be designed to rotate either in the same direction or in the opposite direction to the rotating direction of the blotter roller 112. A brush roller 318*b* may be provided as a second cleaning roller for the blotter roller 112, which brush roller 318*b* is in contact with the cleaning roller 318*d***.

Figure 7:
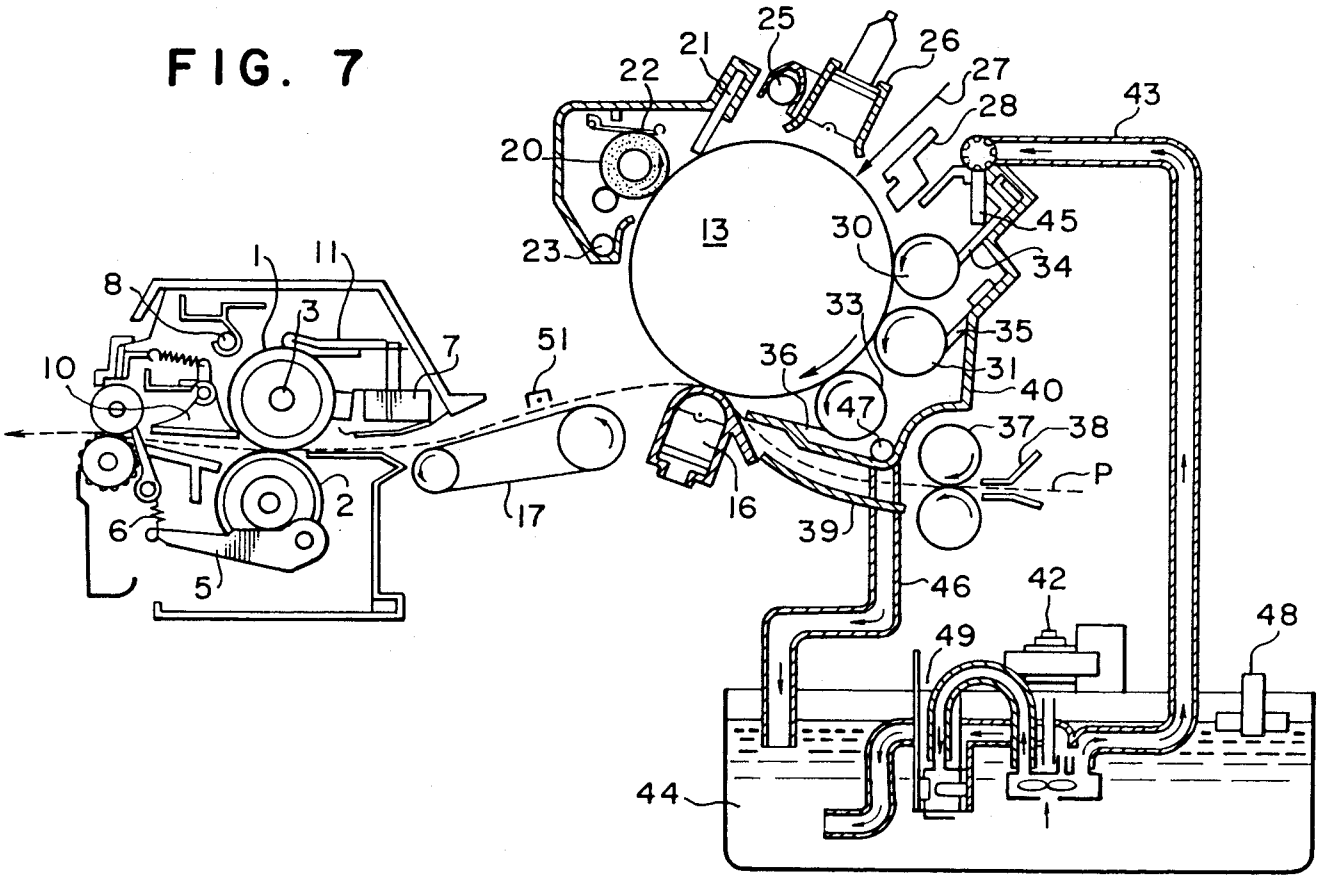
FIG. 7 is a schematic diagram of a fifth example of an image fixing unit according to the present invention.

FIG. 7 schematically shows a fifth example of an image fixing unit according to the present invention. In this image fixing unit, there is provided a squeezing charger 51 as the non-thermal carrier liquid content reduction means. As shown in FIG. 7, the squeezing charger 51 is disposed so as to be directed to an unfixed-toner-image bearing side of a transfer sheet P which is transported along a transfer sheet transportation belt 17, subsequent to the image transfer to the transfer sheet by an image-transfer charger 16, and applies thereto an electric charge, for instance, of −5 kV to −6 kV, having the same polarity as that of the unfixed toner particles on the transfer sheet P, so that the excessive liquid carrier component is squeezed from the unfixed toner particles.

Figure 8:
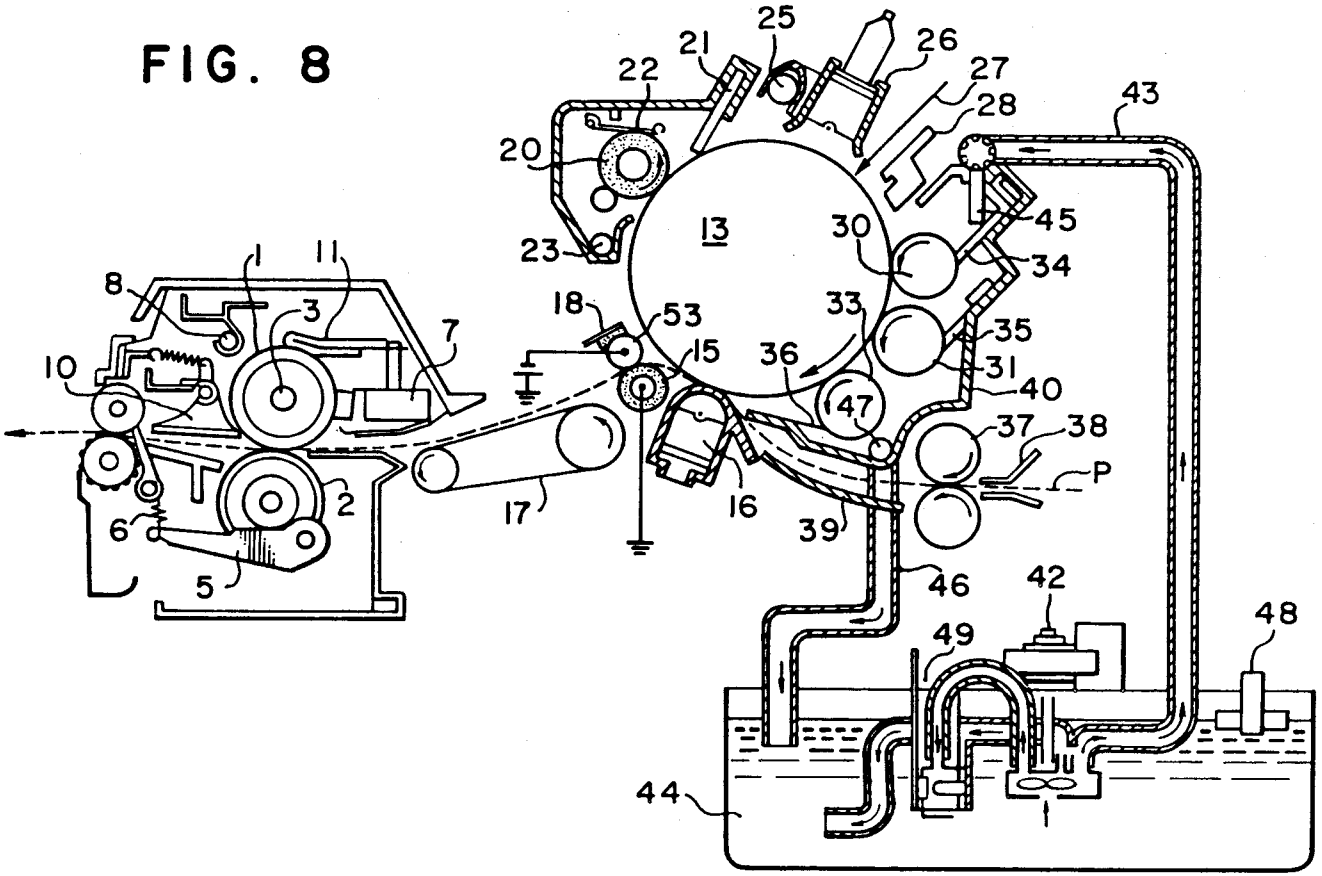
FIG. 8 is a schematic diagram of a sixth example of an image fixing unit according to the present invention.

FIG. 8 schematically shows a sixth example of an image fixing unit according to the present invention. In this image fixing unit, there is provided a bias roller 53 as the non-thermal carrier liquid content reduction means. The bias roller 53 is disposed in rotatable contact with a sponge roller 15. In this example, a bias voltage of −5 kV to −6 kV, having the same polarity as that of the toner particles contained in a developer deposited imagewise on a transfer sheet P, is applied to the unfixed toner image, so that the toner particles are repelled to the transfer sheet P, and the carrier liquid remaining in the deposited developer is caused to move upward.

The thus upward moved carrier liquid adheres to or is trapped by the bias roller 53 and is then recovered by a cleaning pad 18. The spongy portion of the sponge roller 15 serves to prevent the short-circuit between (i) the core portion of the sponge roller 15 which serves as the counter electrode of the bias roller 53 and (ii) the bias roller 53, and to hold the transfer sheet P softly between the bias roller 53 and the sponge roller 15 without corrupting the unfixed toner images formed on the transfer sheet P.

Figure 2:
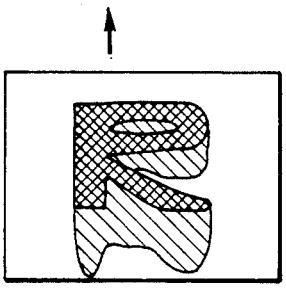
FIG. 2 is an illustration of an example of image flow.
Figures 1, 9:
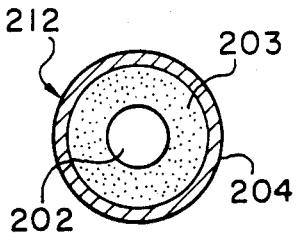
Figures 2, 9:
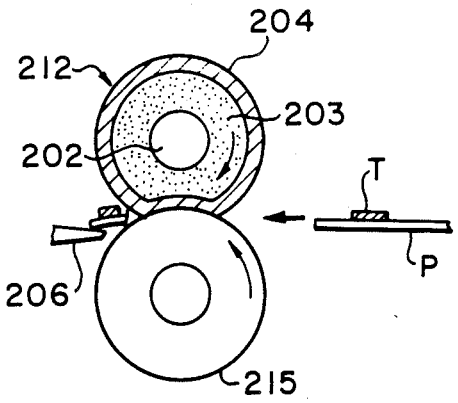

FIGS. 9-1 and 9-2 show a seventh example of an image fixing unit according to the present invention, which is particularly effective for preventing the previously mentioned conventional problem of the so-called "face-curl".

FIG. 9-1 is a schematic cross-sectional view of a blotter roller 212 for use in this image fixing unit.

As shown in the figure, the blotter roller 212 is formed by coating a core 202 with an elastic material 203 such as a sponge-like material or a rubber, and then further coated with an carrier-liquid-absorbing material 204 such as nonwoven fabric, felt or synthetic leather.

A back-up roller 215 for this image fixing unit is rigid, made of a metal or a resin, and combined with the above mentioned blotter roller 212 as shown in FIG. 9-2. This combination can attain not only a large nip between the two rollers 212 and 215, but also a convex curl of the transfer sheet, so that the transfer sheet can be guided to the thermal image fixing means (heat-application roller and pressure-application roller) without causing the previously mentioned face-curl problem, with the aid of a paper guide plate 206 or a paper separating pawl (not shown in FIG. 9-2) which is located under the transfer sheet transportation path.

Figure 10:
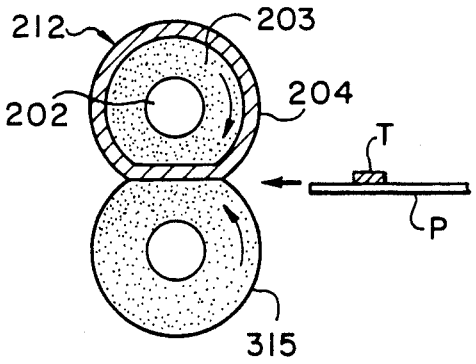
FIG. 10 is a schematic diagram of an eighth example of an image fixing unit according to the present invention.

FIG. 10 shows an eighth example of an image fixing unit according to the present invention, in which both a blotter roller 212 and a back-up roller 315 are elastic rollers. In such a case, the back-up roller 315 is made of an elastic material such as a sponge-like material or a rubber.

As shown in FIG. 10, a transfer sheet P is caused to pass through the elastic blotter roller 212 and the elastic back-up roller 315. In this case, the nip between two rollers becomes flat, so that the transfer sheet P can be transported between the blotter roller 212 and the back-up roller 315, without curling. The transfer sheet P is thus transported to the thermal image fixing means in a stable manner.

As previously mentioned, the blotter roller 212 has a multi-layered structure, comprising a core, an elastic material such as a sponge-like material or a rubber formed on the core, and a carrier-liquid-absorbing material such as nonwoven fabric, felt or synthetic leather formed on the elastic material. Alternatively, the blotter roller 212 may be made of an elastic material such as silicone rubber, which has swelling tendency to a solvent.

FIGS. 11-1, 11-2 and 11-3 show a ninth example of an image fixing unit according to the present invention.

Figures 1, 11:
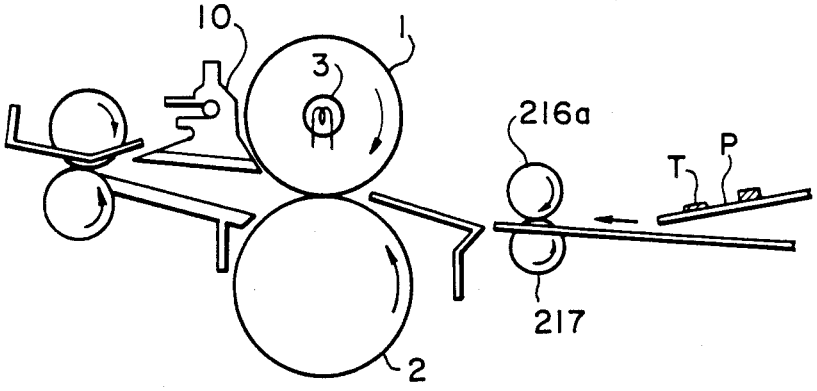
Figures 2, 11:
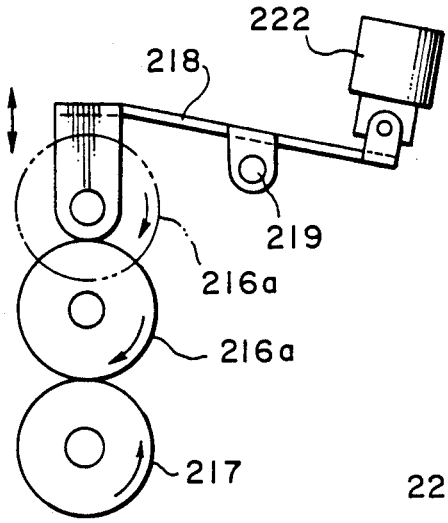
Figures 3, 11:
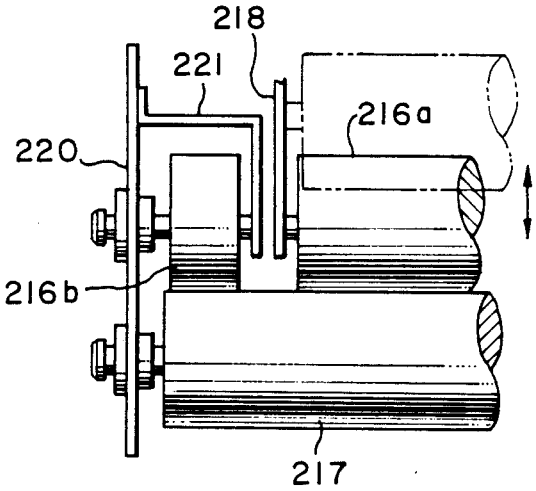

FIG. 11-1 shows a schematic diagram of a wet-type electrophotographic copying machine in which the ninth example of the image fixing unit is incorporated.

This image fixing unit comprises a blotter roller **216*a* and a back-up roller 217. The position of the blotter roller 216*a* can be vertically switched from (i) a lower position at which the blotter roller 216*a* is in contact with the back-up roller 217 to (ii) an upper position at which the blotter roller 216*a* is detached from the back-up roller 217, and vice versa, depending on the carrier-liquid-absorbing capacity of the transfer sheet employed. When a transfer sheet with low carrier-liquid-absorbing capacity is employed, the blotter roller 216*a* is moved downward to the lower position to absorb the carrier liquid component contained in the developer deposited imagewise on the transfer sheet. By contrast to this, when a transfer sheet with high carrier-liquid-absorbing capacity such as plain paper is employed, the blotter roller 216*a* is moved upward to the upper position and detached from the back-up roller 217**.

In this image fixing unit, a transfer sheet transportation roller **216*b* is also provided, which is in rotatable contact with the back-up roller 217. When the blotter roller 216*a* is located in the above-mentioned upper position, the back-up roller 217 serves as a transporting roller in combination with the transfer sheet transportation roller 216*b***.

The above-mentioned detachable mechanism of the blotter roller **216*a* will now be explained in detail by referring to FIGS. 11-2 and 11-3**.

As shown in FIG. 11-2, the blotter roller **216*a*, made of a carrier-liquid-absorbing material such as nonwoven fabric, is supported by one end of a movable bracket 218 which is rotatable on a pivot 219. The other end of the movable bracket 218 is connected to an operating rod of a solenoid 222. By this mechanism, the blotter roller 216*a* can be elevated from the lower position where the blotter roller 216*a* is in contact with the back-up roller 217 to the upper position where the blotter roller 216*a* is detached from the back-up roller 217 as indicated by the chain-line in FIG. 11-2**.

The transfer sheet transportation roller **216*b* is shorter than the blotter roller 216*a* and is supported by a bracket 221 fastened to a side plate 220. Although the blotter roller 216*a* and the transfer sheet transportation roller 216*b* are separately driven, they are disposed coaxially as shown in FIG. 11-3**.

In this example, the back-up roller 217 drives the blotter roller **216*a* in rotation when the blotter roller 216*a* is moved downward and brought into contact with the back-up roller 217. The back-up roller 217 may be a rigid roller, but it is preferably made of an elastic material because the contact area between the back-up roller 217 and the blotter roller 216*a* can be increased, and the carrier liquid absorbing time can be extended. Furthermore, as the elastic material for the back-up roller 217**, a sponge-like material is suitable from the viewpoint of carrier-liquid-absorbing capacity.

When a transfer sheet with low carrier-liquid-absorbing capacity, such as an OHP film or an intermediate original sheet, is employed, the blotter roller **216*a* is brought into contact with the back-up roller 217** to absorb the carrier liquid contained in the developer deposited on the transfer sheet.

When a transfer sheet with high carrier-liquid-absorbing capacity, such as plain paper, is employed the blotter roller **216*a* is vertically elevated to be detached from the back-up roller 217, so that the transfer sheet can be properly transported with the aid of the transfer sheet transportation roller 216*b* and the back-up roller 217** which serves as a counterpart of the transfer sheet transportation roller.

It is preferable that the length of the blotter roller **216*a* correspond to the width of an image area on the transfer sheet employed and the length of the transfer sheet transportation roller 216*b* correspond to the width of a non-image area thereon Thus, carrier-liquid-absorbing capacity of the blotter roller 216*a* can be maintained high for an extended period of time. The material for the transfer sheet transportation roller 216*b*** is not necessarily limited to the carrier-liquid-absorbing material.

Figures 1, 12:
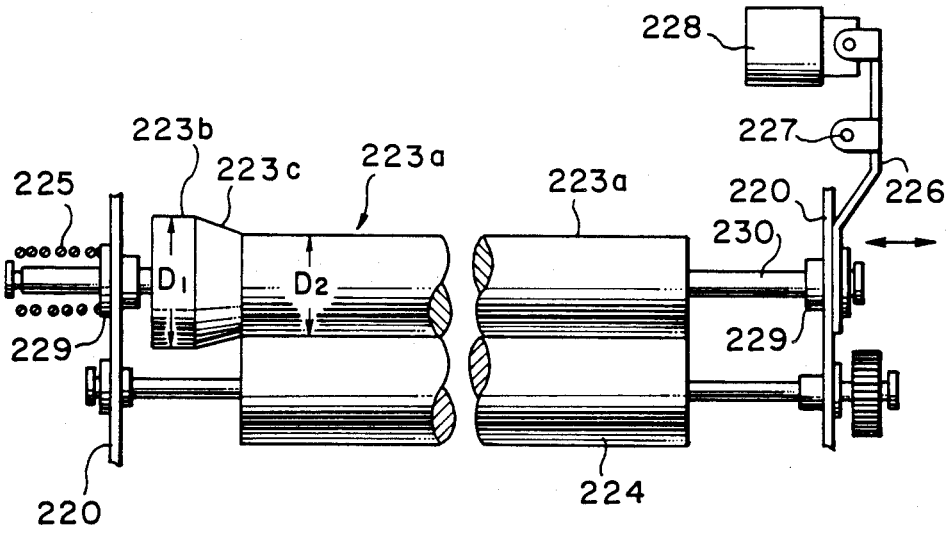
Figures 2, 12:
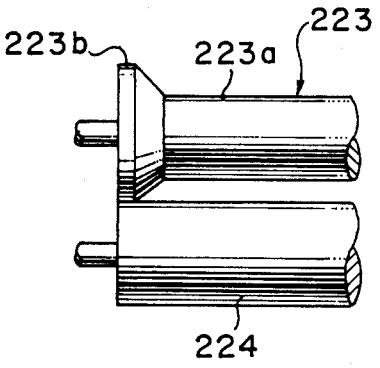

FIGS. 12-1 and 12-2 show a tenth example of an image fixing unit according to the present invention.

As shown in FIG. 12-1, a blotter roller **223*a* is made integral with a transfer sheet transportation roller 223*b* as one roller, which are connected through a tapered portion 223*c*. The outer diameter of the transfer sheet transportation roller 223*b* ($D_1$) is greater than that of the blotter roller 223*a* ($D_2$). The blotter roller 223*a* and the transfer sheet transportation roller 223*b* are designed to be movable in the axial direction thereof as well as in the direction perpendicular to the axis thereof and are supported by a side plate 220 via a bearing 229. The blotter roller 223*a* can be brought into contact with a back-up roller 224 by a spring 225 by which the blotter roller 223*a* is urged leftward in FIG. 12-1**.

One end of a movable bracket 226 which is rotatable on a pivot 227 is connected to the blotter roller axis 230. The other end of the movable bracket 226 is attached to a solenoid 228. The solenoid 228 is capable of shifting the blotter roller **223*a* to a first position, as shown in FIG. 12-1, where the blotter roller 223*a* is in contact with the back-up roller 224, or to a second position, as shown in FIG. 12-2, where the blotter roller 223*a* is detached from the back-up roller 224 and the transfer sheet transportation roller 223b is in contact with the back-up roller 224**.

Depending on the carrier-liquid-absorbing capacity of the transfer sheet employed, the blotter roller 223a is shifted by the switching of the solenoid 228 to the first position or the second position.

In this structure, it is preferable that the length of the blotter roller 223a correspond to the width of an image area on the transfer sheet employed and the length of the transfer sheet transportation roller 223b correspond to the width of a non-image area thereon, whereby the carrier-liquid-absorbing capacity of the blotter roller 223a can be maintained high for an extended period of time. The material for the transfer sheet transportation roller 223b is not necessarily limited to the carrier-liquid-absorbing material.

Figure 13:
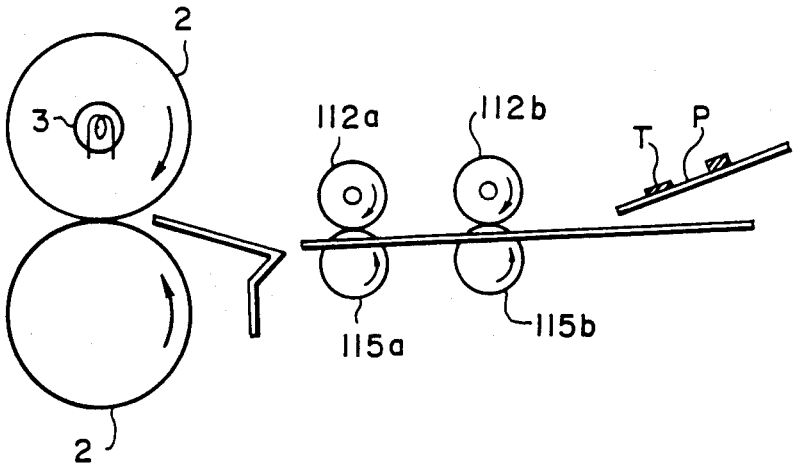
FIG. 13 is a schematic diagram of an eleventh example of an image fixing unit according to the present invention.

For increasing the nip (l) between the blotter roller and the back-up roller, the number of the pair of the blotter roller and the back-up roller may be increased to two or more as in an eleventh example of an image fixing unit according to the present invention as shown in FIG. 13.

For example, when a transfer sheet is caused to pass through the nip between a blotter roller and a back-up roller rotating at a linear speed of 200 mm/sec, with a pressure of 0.2 kg/cm$^2$ applied therebetween, the nip suitable for practical use between the two rollers is considered to be 2 to 5 mm. The nip necessary for sufficiently decreasing the carrier liquid retention ratio of the developer deposited on the transfer sheet is 12 mm or more, so that two or three pairs of the blotter roller and back-up roller will be necessary for use in practice. In FIG. 13, reference numerals 112a and 112b indicate blotter rollers, and reference numerals 115a and 115b indicate back-up rollers.

Figure 14:
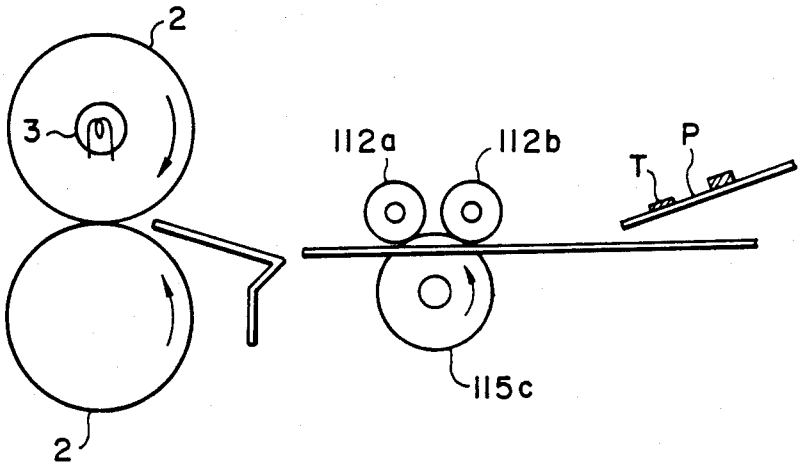
FIG. 14 is a schematic diagram of a twelfth example of an image fixing unit according to the present invention.

Alternatively, the number of the back-up rollers to be combined with one back-up roller can be increased as in a twelveth example of an image fixing unit according to the present invention, which is shown in FIG. 14, whereby the transfer sheet can be surely transported and the transfer sheet transportation reliability can be improved. In addition, the necessary carrier liquid reduction capacity can be appropriately distributed to those blotter rollers.

Figure 15:
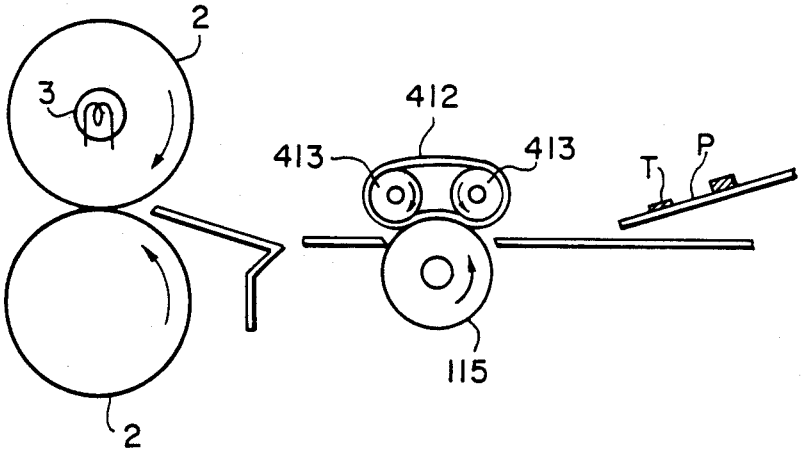
FIG. 15 is a schematic diagram of a thirteenth example of an image fixing unit according to the present invention.

The nip between the blotter roller and the back-up roller can be increased by "a blotter belt method" in which the blotter roller is formed into a belt (referred to as the blotter belt 412) as in a thirteenth example of an image fixing unit according to the present invention as shown in FIG. 15. The blotter belt 412 is trained over a pair of pulleys 413 and is brought into contact with one back-up roller 115.

Figure 16:
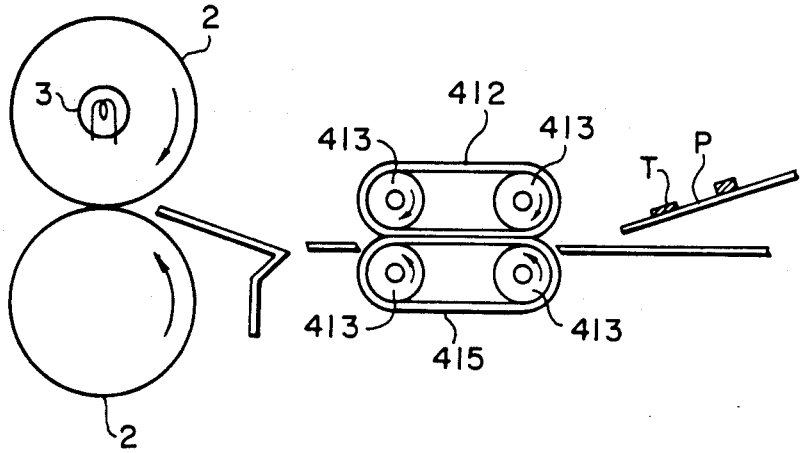
FIG. 16 is a schematic diagram of a fourteenth example of an image fixing unit according to the present invention.

FIG. 16 shows a fourteenth example of an image fixing unit according to the present invention using another modified blotter belt method, in which the back-up roller is also formed into a belt (referred to as the back-up belt 415). The transfer sheet is caused to pass through the nip between the blotter belt 412 and the back-up belt 415, both of which are separately turned around respective two pulleys 413.

By forming the blotter roller into a belt, as previously mentioned, the nip can be easily increased, so that the carrier liquid retention ratio of the developer deposited on the transfer sheet can be decreased sufficiently for preventing the image flow in the course of image fixing. Furthermore, the blotter belt method can cope with high-speed transportation of the transfer sheet, and accordingly it is effective when used in a high-speed electrophotographic copying machine.

The inventors of the present invention have discovered that the following formula can be applied to the carrier liquid absorbing capacity of the blotter rollers employed in the present invention:

$$W \propto \sqrt{FT}$$

where W is the amount of a carrier liquid absorbed by a blotter roller, F is the contact pressure applied to an unfixed toner image by the blotter roller, and T is the period of time in which the blotter roller is in contact with the unfixed toner image.

In view of the above relationship, the greater the contact pressure, the greater the amount of the carrier liquid absorbed by the blotter roller; and the longer the contact time, the greater the the amount of the carrier liquid absorbed by the blotter roller. Therefore, by adjusting the above two factors, F and T, the occurrence of the image flow can be minimized or prevented completely.

Figure 17A:
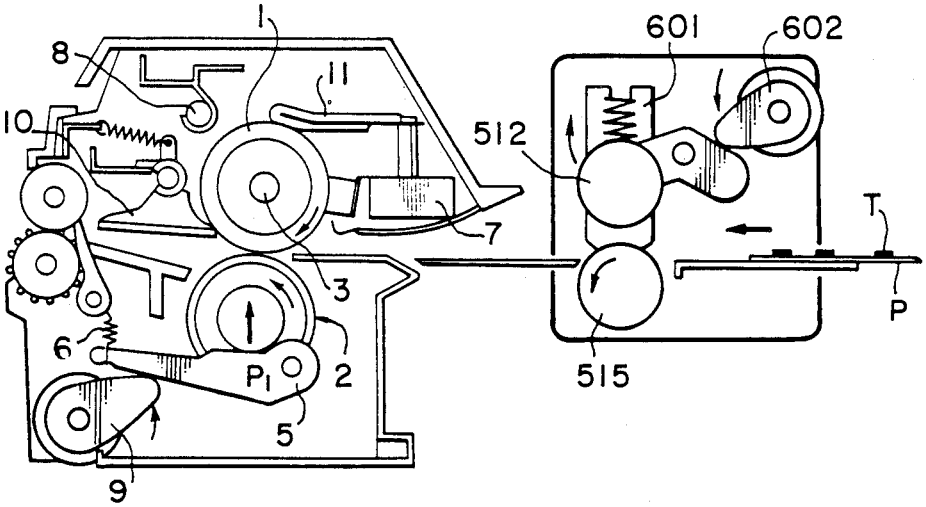
FIGS. 17A and 17B are schematic diagrams of a fifteenth example of an image fixing unit according to the present invention.
Figure 17B:
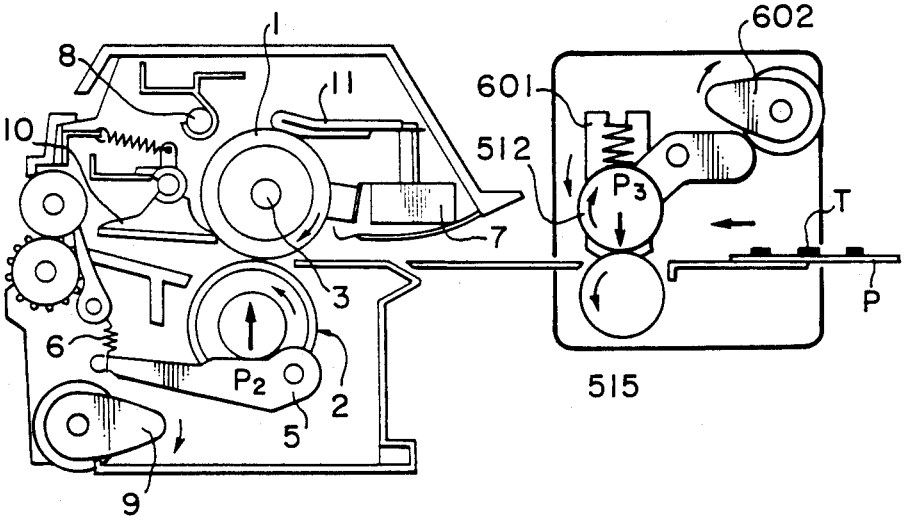

FIGS. 17A and 17B are schematic diagrams of a fifteenth example of an image fixing unit according to the present invention.

In this image fixing unit, a blotter roller 512 is selectively detachable from a back-up roller 515 depending upon the carrier-liquid-absorbing capacity of a transfer sheet to be employed.

FIG. 17A shows the case where a transfer sheet having high carrier-liquid-absorbing capacity, such as plain paper, is employed. In this case, the transfer sheet itself is capable of sufficiently absorbing a carrier liquid contained in an unfixed toner image on the transfer sheet, so that it will be unnecessary to further absorb the carrier liquid from the unfixed toner image by the blotter roller 512 before the unfixed toner image is transported to a thermal image fixing section. Therefore, the blotter roller 512 is detached from the back-up roller 515 by the counterclockwise rotation of an eccentric cam 602 against the resilience of a spring 601.

In the thermal image fixing section, there are provided a heat-application roller 1 with an inner heater of a power of 750 W at 100 V, and a pressure-application roller which is urged against the pressure-application roller 1 with a contact pressure $P_1$, for example, about 40 kgf or more, by a pressure-application lever 5, an eccentric cam 9 and a spring 6.

In this case, the contact pressure $P_1$ is set so as to be greater than a contact pressure $P_2$ at which image fixing is performed to an OHP film. This is because when a solid toner image is formed on a plain paper, with high and uniform density, it is preferable to thermally extend the toner particles in the toner image.

FIG. 17B shows the case where a transfer sheet having low carrier-liquid-absorbing capacity, such as OHP film, is employed. In this case, the transfer sheet itself is not capable of sufficiently absorbing the carrier liquid contained in an unfixed toner image formed on the transfer sheet, so that it is necessary to further absorb the carrier liquid from the unfixed toner image by the blotter roller 512 before the unfixed toner image is transported to a thermal image fixing section. Therefore, the blotter roller 512 is in pressure contact with the back-up roller 515 with a contact pressure $P_3$, for example, about 1 kgf, by the clockwise rotation of the eccentric cam 602 following the resilience of the spring 601.

In the thermal image fixing section the pressure-application roller is urged against the pressure-application roller 1 with a contact pressure $P_2$, for example, 15 kgf, by the pressure-application lever 5, the eccentric cam 9 and the spring 6.

In this case, the contact pressure $P_2$ is set so as to be smaller than the contact pressure $P_1$ at which image fixing is performed to plain paper. This is because when a greater pressure is applied to the OHP film when image fixing is performed thereto, image flow becomes apt to occur.

What is claimed is:

1. An image fixing unit for a wet-type electrophotographic copying machine capable of forming a latent electrostatic image on a photoconductor element, developing said latent electrostatic image to a visible toner image by a developer comprising a carrier liquid and toner particles and transferring said visible toner image to a transfer sheet, comprising:

(a) a non-thermal carrier liquid content reduction means for reducing the content of said carrier liquid in said developer deposited on said transfer sheet without application of heat thereto, and (b) a thermal image fixing means for fixing said toner image to said transfer sheet by directly heating said toner image formed on said transfer sheet after the reduction of the content of said carrier liquid in said developer deposited on said transfer sheet by said non-thermal carrier liquid content reduction means;

wherein said non-thermal carrier liquid content reduction means comprises:

at least one elastic blotter roller capable of absorbing said carrier liquid; and at least one back-up roller for bringing said transfer sheet into contact with said elastic blotter roller, with the toner image bearing side thereof being in contact with said elastic blotter roller, and said back-up roller being rotatable in contact with said elastic blotter roller;

wherein said back-up roller is an elastic roller capable of forming a nip between said elastic blotter roller and said back-up roller.

2. The image fixing unit for a wet-type electrophotographic copying machine as claimed in claim 1, wherein said elastic blotter roller is selectively detachable so as to be out of contact with said back-up roller, depending upon the kind of said transfer sheet.

3. The image fixing unit for a wet-type electrophotographic copying machine as claimed in claim 2, further comprising a transfer sheet transportation roller which is in rotatable contact with said back-up roller.

4. The image fixing unit for a wet-type electrophotographic copying machine as claimed in claim 2, further comprising a transfer sheet transportation roller which is integral with said elastic blotter roller and movable so as to be rotatable in contact with said back-up roller.

5. The image fixing unit for a wet-type electrophotographic copying machine as claimed in claim 1, further comprising a cleaning means for cleaning said elastic blotter roller.

6. The image fixing unit for a wet-type electrophotographic copying machine as claimed in claim 1, further comprising a cleaning means for cleaning said back-up roller.

7. An image fixing unit for a wet-type electrophotographic copying machine capable of forming a latent electrostatic image on a photoconductor element, developing said latent electrostatic image to a visible toner image by a developer comprising a carrier liquid and toner particles and transferring said visible toner image to a transfer sheet, comprising:

(a) a non-thermal carrier liquid content reduction means for reducing the content of said carrier liquid in said developer deposited on said transfer sheet without application of heat thereto, and (b) a thermal image fixing means for fixing said toner image to said transfer sheet by directly heating said toner image formed on said transfer sheet after the reduction of the content of said carrier liquid in said developer deposited on said transfer sheet by said non-thermal carrier liquid content reduction means;

wherein said non-thermal carrier liquid content reduction means comprises:

a plurality of elastic blotter rollers capable of absorbing said carrier liquid; and at least one back-up roller for bringing said transfer sheet into contact with said elastic blotter roller, with the toner image bearing side thereof being in contact with said elastic blotter roller, and said back-up roller being rotatable in contact with said elastic blotter rollers.

8. An image fixing unit for a wet-type electrophotographic copying machine capable of forming a latent electrostatic image on a photoconductor element, developing said latent electrostatic image to a visible toner image by a developer comprising a carrier liquid and toner particles and transferring said visible toner image to a transfer sheet, comprising:

(a) a non-thermal carrier liquid content reduction means for reducing the content of said carrier liquid in said developer deposited on said transfer sheet without application of heat thereto, and (b) a thermal image fixing means for fixing said toner image to said transfer sheet by directly heating said toner image formed on said transfer sheet after the reduction of the content of said carrier liquid in said developer deposited on said transfer sheet by said non-thermal carrier liquid content reduction means;

wherein said non-thermal carrier liquid content reduction means comprises:

a rotatable endless blotter belt capable of absorbing said carrier liquid trained over a plurality of pulleys; and at least one back-up roller for bringing said transfer sheet into contact with said endless blotter belt, with the toner image bearing side thereof being in contact with said endless blotter belt, and said rotatable endless blotter belt being rotatable in contact with said back-up roller.

9. An image fixing unit for a wet-type electrophotographic copying machine capable of forming a latent electrostatic image on a photoconductor element, developing said latent electrostatic image to a visible toner image by a developer comprising a carrier liquid and toner particles and transferring said visible toner image to a transfer sheet, comprising:

(a) a non-thermal carrier liquid content reduction means for reducing the content of said carrier liquid in said developer deposited on said transfer sheet without application of heat thereto, and (b) a thermal image fixing means for fixing said toner image to said transfer sheet by directly heating said toner image formed on said transfer sheet after the reduction of the said transfer sheet by said non-thermal carrier liquid content reduction means;

wherein said non-thermal carrier liquid content reduction means comprises:

a rotatable endless blotter belt capable of absorbing said carrier liquid trained over a plurality of pulleys; and a rotatable endless belt for bringing said transfer sheet into contact with said rotatable endless blotter belt, with the toner image bearing side thereof being in contact with said rotatable endless blotter belt, and said rotatable endless blotter belt being rotatable in contact with said rotatable endless belt.

* * * * *

UNITED STATES PATENT AND TRADEMARK OFFICE

CERTIFICATE OF CORRECTION

PATENT NO. : 4,985,733

DATED : January 15, 1991

INVENTOR(S) : Tsuneo Kurotori, et al

It is certified that error appears in the above-identified patent and that said Letters Patent is hereby corrected as shown below:

In column 10, line 60, after "with" delete "an" and insert --a--.

In column 12, line 40, after "thereon" insert --.--.

In column 13, line 39, delete "twelveth" and insert --twelfth--.

In column 13, line 61, after "around" insert --the two--; same line after "respective" delete "two".

In column 17, line 1 after "the" insert --content of said carrier liquid in said developer deposited on--.

Signed and Sealed this

Eleventh Day of August, 1992

*Attest:*

DOUGLAS B. COMER

*Attesting Officer*

*Acting Commissioner of Patents and Trademarks*